United States Patent [19]

Colling et al.

[11] 4,366,953

[45] Jan. 4, 1983

[54] OXYGEN LANCE

[75] Inventors: J. Colling; C. Heintz, both of Luxembourg, Luxembourg

[73] Assignee: ARBED S.A., Luxembourg, Luxembourg

[21] Appl. No.: 311,013

[22] Filed: Oct. 13, 1981

[30] Foreign Application Priority Data

Oct. 13, 1980 [LU] Luxembourg ..... 82846

[51] Int. Cl.[3] ..... C21B 7/16

[52] U.S. Cl. ..... 266/266; 75/60

[58] Field of Search ..... 266/266; 75/60

[56] References Cited

U.S. PATENT DOCUMENTS 3,661,560 5/1972 Grenfell ..... 75/60
4,190,238 2/1980 Schoop ..... 75/60
4,303,230 12/1981 Bleloch ..... 75/60

FOREIGN PATENT DOCUMENTS 2002814 9/1972 Fed. Rep. of Germany .
2259276 11/1975 Fed. Rep. of Germany .
934112 8/1963 United Kingdom .
1190137 4/1970 United Kingdom .
1349069 3/1974 United Kingdom .
348613 of 0000 U.S.S.R.
438702 of 0000 U.S.S.R.

*Primary Examiner*—P. D. Rosenberg
*Attorney, Agent, or Firm*—Karl F. Ross

[57] ABSTRACT

A lance for blowing oxygen from above into a ladle of an iron foundry has a nozzle head with at least four main tuyeres of larger diameter and as many ancillary tuyeres of smaller diameter, the larger tuyeres serving to blow into the melt for decarburizing the metal while the smaller ones promote afterburning of the evolving carbon monoxide just above the melt surface. The axes of the main tuyeres are inclined to the nozzle-head axis at an angle of about 14° to 17° while the axes of the ancillary tuyeres have an angle of inclination exceeding that of the main tuyeres by about 30° to 50°. In order to slow down the air flow through the ancillary tuyeres with reference to the surface-penetrating jets of the main tuyeres, the former are provided with inner peripheral inlays or grooves of annular or helicoidal shape.

12 Claims, 8 Drawing Figures

OXYGEN LANCE

FIELD OF THE INVENTION

Our present invention relates to a lance used in a refining furnace of an iron foundry for blowing oxygen from above into a ladle containing a ferrous melt.

BACKGROUND OF THE INVENTION

The refining of pig iron generally involves the removal of some of its carbon content by reaction with the supplied oxygen which may be blown in from above and/or bubbled up from the bottom of the melt. Since this oxidation is an exothermic process, solid materials such as scrap iron and iron-rich ores are also introduced to control the bath temperature. The amount of scrap that can be added depends on the proportions of carbon and other oxidizable elements such as silicon, phosphorus and manganese present in the melt; this amount can be increased by igniting the combustible gases—especially carbon monoxide—evolving from its surface.

In commonly owned Luxembourg Pat. No. 81,207 (see also copending U.S. application Ser. No. 222,716 filed Jan. 5, 1981 by Paul Metz et al, now U.S. Pat. No. 4,334,922) there has been described such an afterburning process according to which oxygen blown in from above is spread over the bath surface to react with the CO. A concurrent injection of substantially inert gas from below controls the thickness of the slag layer floating on the bath and prevents it from assuming a foamy consistency which in earlier processes causes that layer to act as a heat insulator. As a result, heat from the afterburning process penetrating the slag layer raises the surface temperature of the bath and enables the utilization of larger quantities of scrap iron and other cooling materials.

A lance supplying oxygen for both decarburization and afterburning must therefore be designed to direct a primary jet through the slag layer into the melt and to train additional jets onto the bath surface. A known nozzle head provided for this purpose has a main axial tuyere surrounded by several ancillary tuyeres whose axes lie skew to the central nozzle axis. These prior nozzle structures, however, do not always operate satisfactorily and in some instances have been found to ignite the evolving CO in a region relatively remote from the bath surface, thereby reducing the heat available for scrap melting and even endangering the lance itself as well as the exhaust system overlying the ladle.

OBJECT OF THE INVENTION

The object of our present invention, therefore, is to provide an improved nozzle head for a lance of this character which satisfies the aforestated requirements and is of simple yet sturdy construction.

SUMMARY OF THE INVENTION

We have found, in accordance with our present invention, that this object is attainable by the provision of a nozzle head whose generally cylindrical body has a bottom penetrated by a plurality of main tuyeres of relatively large internal diameter and by a like plurality of ancillary tuyeres of relatively small internal diameter, the main tuyeres having axes inclined to the central body axis at an angle of about 14° to 17° while the axes of the ancillary tuyeres are inclined to that central axis at an angle exceeding the angle of inclination of the main tuyeres by about 30° to 50°.

In this way, and especially when the discharge ends of the main tuyeres have substantially twice the diameter of the discharge ends of the ancillary tuyeres, a suitable volume ratio between the penetrating oxygen jets and the surface-sweeping jets is established when both sets of tuyeres receive oxygen at the same pressure from a common source. We prefer to use at least four main tuyeres and as many ancillary tuyeres.

The nozzle head according to our invention may therefore have a single plenum chamber communicating with all the tuyeres. Since, however, not only the combined flow rate but also the flow velocity of the ancillary jets should be suitably reduced with reference to the corresponding parameters of the main jets emitted by the nozzle head, we prefer to provide the ancillary tuyeres with internal flow-retarding formations.

BRIEF DESCRIPTION OF THE DRAWING

The above and other features of our invention will now be described in detail with reference to the accompanying drawing in which.

SPECIFIC DESCRIPTION

Figure 1:
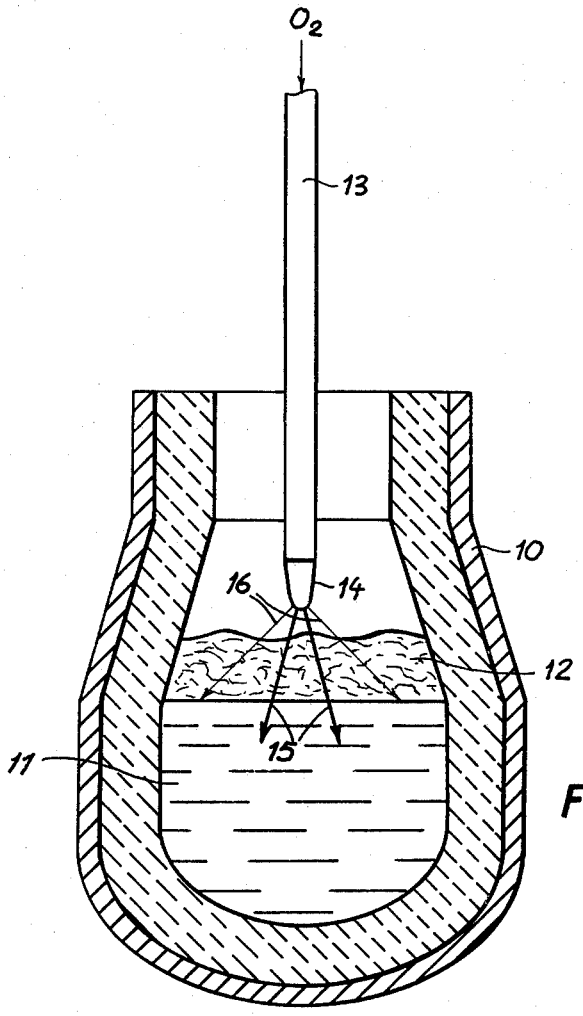
FIG. 1 is a diagrammatic sectional view of a foundry ladle provided with a lance according to our invention.

In FIG. 1 we have schematically indicated a ladle 10 charged with a ferrous melt 11 which is covered by a supernatant slag layer 12. A vertical lance 13 has a nozzle head 14, more fully described hereinafter, from which oxygen is blown in four or more slightly diverging main jets 15 (only two shown) and as many more widely diverging ancillary jets 16. The main jets 15 traverse not only the slag layer 12 but also an upper zone of the bath 11 so as to penetrate to a certain depth into the melt for oxidizing part of its carbon and other nonferrous elements. The ancillary jets 16 also pass through the slag 12 but, being inclined at a substantially greater angle to the vertical and having a lower velocity, are deflected at the slag/melt interface so as to spread their oxygen over the bath surface for igniting and burning the evolving CO gases. While only a single centrally positioned lance 13 is shown, it will be apparent that several such lances could be used, especially with wider vessels.

Figure 3:
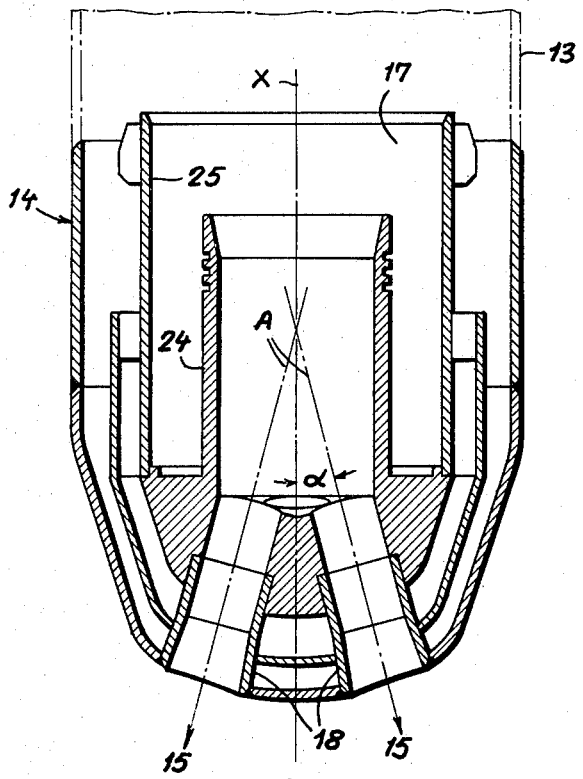
FIGS. 3 and 4 are cross-sectional views respectively taken on lines III—III and IV—IV of FIG. 2.
Figure 4:
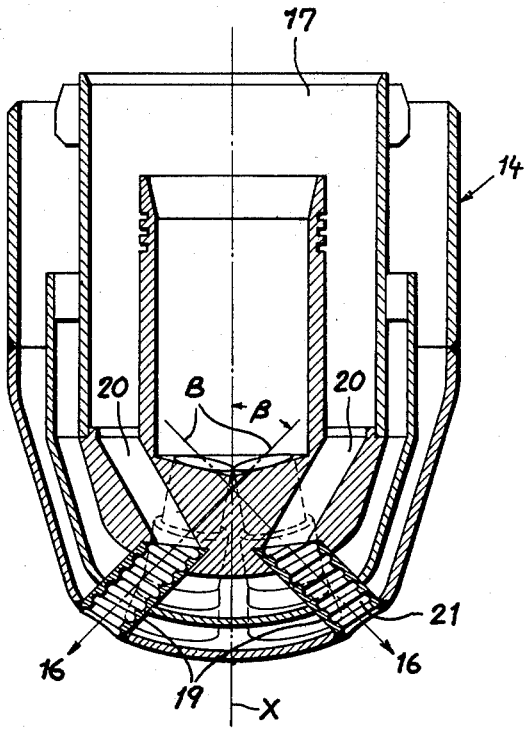
Figure 2:
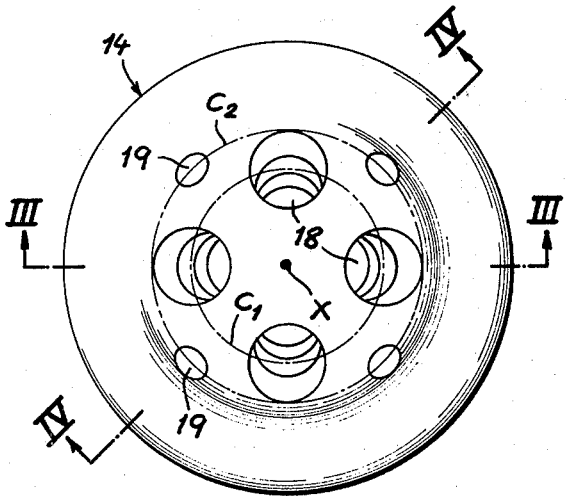
FIG. 2 is an enlarged bottom view of a nozzle head forming part of the lance shown in FIG. 1.

FIGS. 2, 3 and 4 show details of the nozzle head 14 designed to emit the jets 15 and 16. This nozzle head has a generally cylindrical body centered on an axis X and provided with a plenum chamber 17 which communicates with four symmetrically diverging main tuyeres 18 and as many more widely diverging ancillary tuyeres 19. As seen in FiG. 2, the discharge ends of tuyeres 18 are arrayed about axis X on a circle of smaller radius $C_1$ whereas the discharge ends of the ancillary tuyeres 19 are arrayed concentrically thereto—and with an angular offset of offset of 45°—on a circle of larger radius $C_2$.

Figure 7:
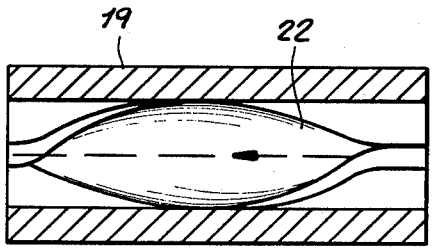
FIGS. 6, 7 and 8 are axial sectional views, drawn to a still larger scale, of ancillary tuyeres of a nozzle head according to our invention provided with various flow-retarding formations.
Figure 8:
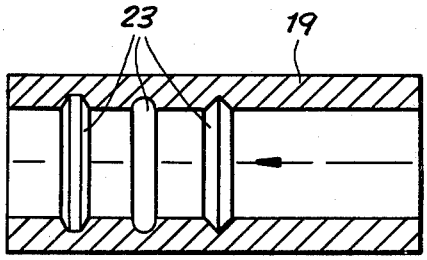
Figure 6:
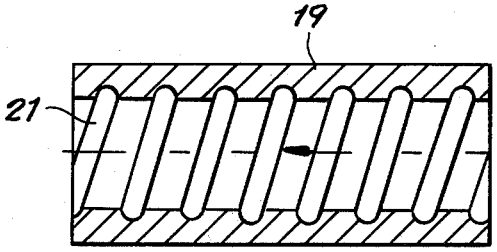

As best seen in FIG. 3, the main tuyeres 18 are straight tubes diverging downwardly from a central part of plenum chamber 17 and widening toward their discharge end, their axes A including with the central nozzle axis X an angle $\alpha$ ranging between about 14° and 17°. From FIG. 4 it will be apparent that the ancillary tuyeres 19 are downwardly diverging lower sections of elbow-shaped ducts whose upper sections 20 converge downwardly from an annular part of plenum chamber 17. The axes B of tuyeres 19 include with axis X an angle $\beta$ which exceeds angle $\alpha$ by about 30° to 50°, thus ranging between substantially 44° and 67°. Tuyeres 19 are further shown to be provided with flow-retarding formations 21, namely helicoidal grooves more clearly illustrated in FIG. 6. Alternate flow-retarding means include a helicoidally curved sheet-metal insert 22 lining the inner tube wall, as shown in FIG. 7, or a set of annular grooves 23 in that wall, as shown in FIG. 8.

Figure 5:
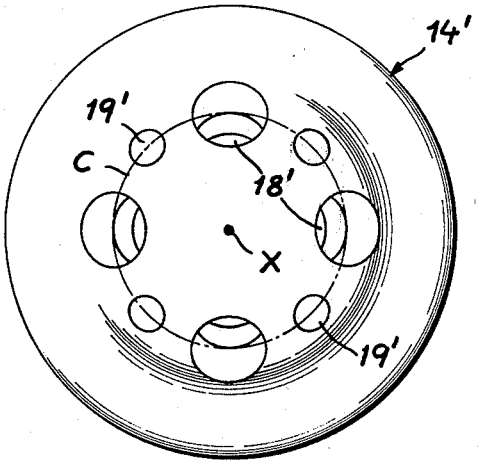
FIG. 5 is a bottom view similar to FIG. 2, showing a modification.

As illustrated in FIG. 5 for a modified nozzle head 14', the outlets of main tuyeres 18' and ancillary tuyeres 19' could also be arrayed on a common circle C centered on axis X.

From FIGS. 2 and 5 it will further be seen that tuyeres 18 or 18' have an outlet diameter which is about twice as large as that of tuyeres 19 or 19'.

While our preferred embodiment utilizes a single source of high-pressure oxygen communicating via the stem of lance 13 with plenum chamber 17, it would be possible in principle to use different sources for the two sets of tuyeres, namely a central conduit fitted onto a tubular boss 24 to supply the main tuyeres 18 or 18' and a surrounding annular conduit terminating at a sleeve 25 for supplying the ancillary tuyeres 19 or 19'. In such a case the flow-retarding means 21–23 could be omitted.

We claim:

1. A nozzle head for an oxygen lance trained from above upon a ferrous melt in a refining furnace, comprising a generally cylindrical body with a central axis, said body having a bottom penetrated by a plurality of main tuyeres and by a like plurality of ancillary tuyeres, said main tuyeres having axes inclined to said central axis at an angle of about 14° to 17°, said ancillary tuyeres having internal diameters smaller than those of said main tuyeres and having axes inclined to said central axis at an angle exceeding the angle of inclination of said main tuyeres by about 30° to 50°.

2. A nozzle head as defined in claim 1 wherein said main tuyeres and said ancillary tuyeres have respective discharge ends circularly arrayed on said bottom.

3. A nozzle head as defined in claim 2 wherein the discharge ends of said main tuyeres have substantially double the diameter of the discharge ends of said ancillary tuyeres.

4. A nozzle head as defined in claim 2 or 3 wherein the centers of the discharge ends of said ancillary tuyeres lie farther than the centers of the discharge ends of said main tuyeres from said central axis.

5. A nozzle head as defined in claim 4 wherein the discharge ends of said ancillary tuyeres are angularly offset from the discharge ends of said main tuyeres.

6. A nozzle head as defined in claim 1, 2 or 3 wherein the number of said main tuyeres and the number of said ancillary tuyeres is at least four.

7. A nozzle head as defined in claim 1, 2 or 3 wherein said body is internally provided with a common plenum chamber communicating with said main and ancillary tuyeres.

8. A nozzle head as defined in claim 7 wherein said ancillary tuyeres are provided with internal flow-retarding formations.

9. A nozzle head as defined in claim 8 wherein said flow-retarding formations are generally helicoidal sheet-metal inserts lining the peripheral walls of said ancillary tuyeres.

10. A nozzle head as defined in claim 8 wherein said flow-retarding formations are grooves cut in the peripheral walls of said ancillary tuyeres.

11. A nozzle head as defined in claim 10 wherein said grooves are generally annular.

12. A nozzle head as defined in claim 10 wherein said grooves are generally helicoidal.

* * * * *